US006588439B2

(12) United States Patent
Wu

(10) Patent No.: US 6,588,439 B2
(45) Date of Patent: Jul. 8, 2003

(54) WIND-PROTECTING SKELETON FOR FOLDING UMBRELLA

(76) Inventor: Tsun-Zong Wu, PO Box 82-144, Taipei (TW)

( * ) Notice: Subject to any disclaimer, the term of this patent is extended or adjusted under 35 U.S.C. 154(b) by 0 days.

(21) Appl. No.: 09/899,247

(22) Filed: Jul. 6, 2001

(65) Prior Publication Data

US 2003/0005951 A1 Jan. 9, 2003

(51) Int. Cl.[7] ..... A45B 25/02
(52) U.S. Cl. ..... 135/27; 135/31
(58) Field of Search ..... 135/27, 31, 23, 135/28, 41, 43, 25.31, 38, 40, 29, 37, 39, 16

(56) References Cited

U.S. PATENT DOCUMENTS 1,064,588 A * 6/1913 Allen ..... 135/25.34
1,104,598 A * 7/1914 Wyskosky ..... 135/23
1,444,017 A * 2/1923 Waschek ..... 135/27
2,143,978 A * 1/1939 Eeles ..... 135/114
2,522,645 A * 9/1950 Senna ..... 135/27
3,930,514 A * 1/1976 Wu ..... 135/119
4,407,317 A * 10/1983 Crandall ..... 135/27
4,986,294 A * 1/1991 Wu ..... 135/22
5,235,998 A * 8/1993 Liu ..... 135/25.3
5,551,463 A * 9/1996 Wang ..... 135/25.3
5,617,889 A * 4/1997 Wu ..... 135/22
5,645,094 A * 7/1997 Wu ..... 135/24
5,787,912 A * 8/1998 Wu ..... 135/29
5,794,637 A * 8/1998 Figueroa ..... 135/27
5,909,746 A * 6/1999 Doster et al. ..... 135/25.1
5,941,261 A * 8/1999 Kouvaras et al. ..... 135/27
6,058,952 A * 5/2000 Lin et al. ..... 135/23
6,186,157 B1 * 2/2001 Lin et al. ..... 135/25.1
6,216,712 B1 * 4/2001 Lin et al. ..... 135/23
6,230,725 B1 * 5/2001 Ko ..... 135/25.3
6,276,380 B1 * 8/2001 Okuda ..... 135/31
6,374,840 B1 * 4/2002 Ma ..... 135/22

* cited by examiner

*Primary Examiner*—Daniel P. Stodola
*Assistant Examiner*—Jennifer E. Novosad
(74) *Attorney, Agent, or Firm*—Leong C. Lei

(57) ABSTRACT

A wind-protecting skeleton for folding umbrella is characterized in a rib-pulling mechanism mounted between each stretcher and each corresponding outer rib of the umbrella. The rib-pulling mechanism includes a flexible pull cord having an inner knotted end connected to a predetermined position on the stretcher and an outer knotted end movably connected to an eye at an inner end of a rigid wire. An eye at an outer end of the rigid wire is pivotally connected to a coupling device fixedly connected to a predetermined position on the outer rib. When the umbrella is stretched, the flexible pull cord and the rigid wire together pull the outer rib inward to protect the same from turning upward or breaking due to a strong wind force against an inner side of the umbrella.

4 Claims, 9 Drawing Sheets

WIND-PROTECTING SKELETON FOR FOLDING UMBRELLA

BACKGROUND OF THE INVENTION

The present invention relates to a wind-protecting skeleton for folding umbrella, and more particularly to an umbrella wind-protecting skeleton that includes rigid wires and flexible pull cords to pull outer ribs of the umbrella inward and does not interfere with a smooth collapsing of the folding umbrella.

FIG. 1 shows a general skeleton for a folding umbrella that typically includes a shaft 11 having multiple telescopic sections, an upper hub 12 fixedly connected to a top of the shaft 11, a lower hub 13 upward and downward movable along the shaft 11, multiple sets of rib members (A), and an umbrella cover 14 connected to and covering a top of the rib members.

Taking a folding umbrella having two telescopic sections in the shaft 11 as an example, each set of rib members (A) include a stretcher 2, an outer rib 3, an auxiliary rib 4, and a link 5, which are pivotally connected to one another in a predetermined manner. The stretcher 2 and the auxiliary rib 4 are pivotally connected at their inner ends to the lower and the upper hubs 13, 12, respectively. When the lower hub 13 is pushed upwardly, all the stretchers 2, the auxiliary ribs 4, the links 5, and the outer ribs 3 of the umbrella are sequentially outwardly extended to stretch the umbrella. And, when the lower hub 13 is downwardly pulled, all the stretchers 2, the auxiliary ribs 4, the links 5, and the outer ribs 3 of the umbrella are sequentially inwardly pulled to collapse the umbrella.

When the umbrella in a stretched state is subject to a strong wind that inclines the umbrella and blows against an inner side of the cover 14, an outer peripheral area of the cover 14 supported by the outer ribs 3 that have relatively weak structure bears a considerably big wind force (P) and tends to be turned upward, as shown in FIG. 2.

SUMMARY OF THE INVENTION

It is a primary object of the present invention to provide a wind-protecting skeleton for folding umbrella to protect the umbrella against upward turned or broken outer ribs under a strong wind force.

Another object of the present invention is to provide a wind-protecting skeleton for folding umbrella that does not interfere with a smooth collapsing of the folding umbrella.

To achieve the above and other objects, the wind-protecting skeleton for folding umbrella of the present invention includes a rib-pulling mechanism mounted between each stretcher and each corresponding outer rib of the umbrella. The rib-pulling mechanism includes a flexible pull cord having an inner knotted end connected to a predetermined position on the stretcher and an outer knotted end movably connected to an eye at an inner end of a rigid wire. An eye at an outer end of the rigid wire is pivotally connected to a coupling device fixedly connected to a predetermined position on the outer rib. When the umbrella is stretched, the flexible pull cord and the rigid wire together pull the outer rib inward to protect the same from turning upward or breaking due to a strong wind force against an inner side of the umbrella.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
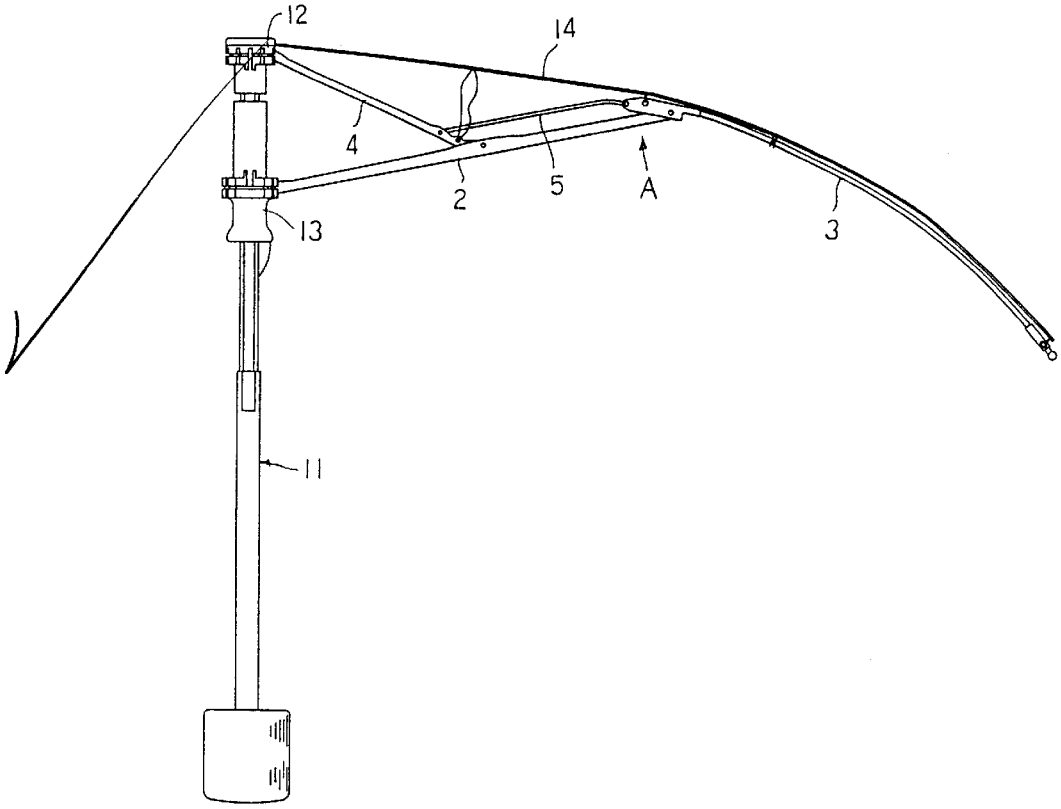
FIG. 1 (PRIOR ART)
FIG. 1 shows a general skeleton for a folding umbrella.
Figure 2:
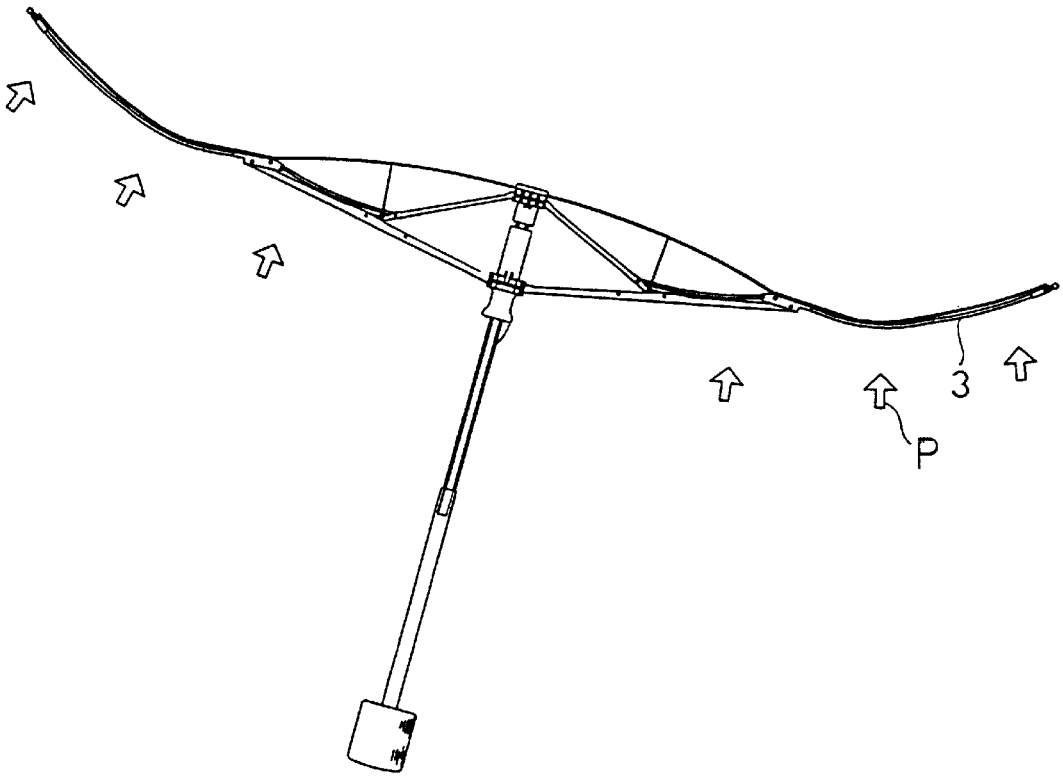
FIG.2 (PRIOR ART)
FIG. 2 shows outer ribs included in the skeleton of FIG. 1 are turned upward by a strong wind.
Figure 3:
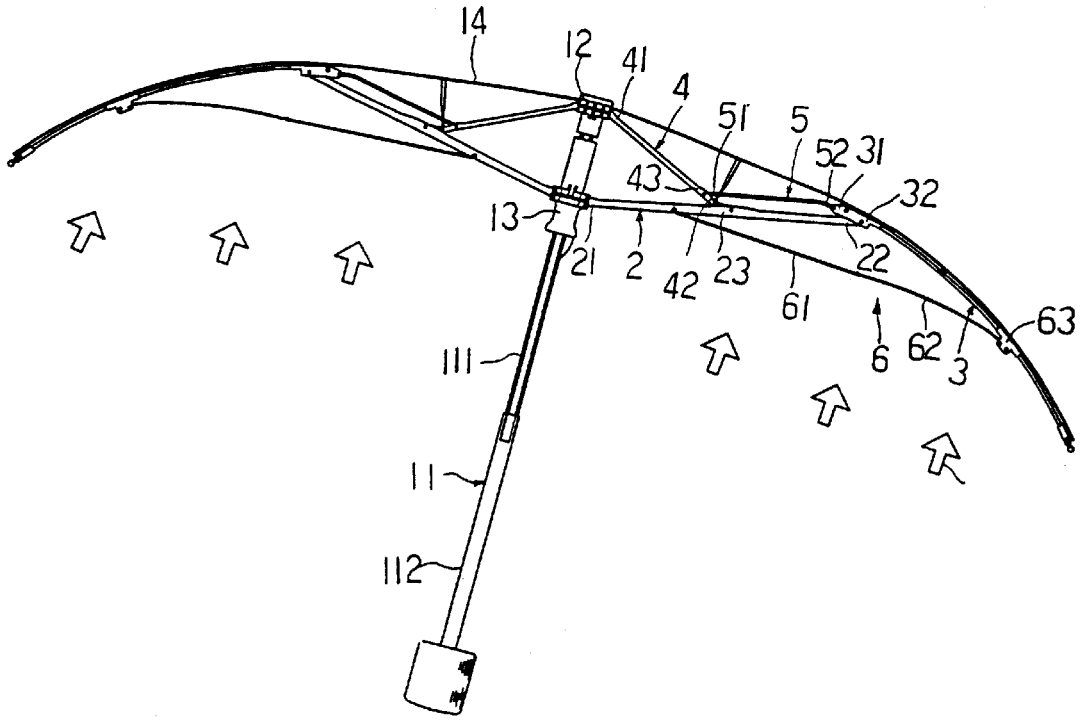
FIG. 3 shows a folding umbrella having a wind-protecting skeleton of the present invention, wherein the umbrella is in a stretched state.

Please refer to FIG. 3 that shows a fully stretched folding umbrella having a wind-protecting skeleton of the present invention. In the illustrated folding umbrella, there is a telescopic shaft 11 consisting of an upper section 111 and a lower section 112, an upper hub 12 fixedly mounted to a top of the upper section 111 of the shaft 11, a lower hub 13 upward and downward movable along the shaft 11, multiple sets of rib members (A) pivotally connected to the upper and the lower hubs 12 and 13, and a cover 14 connected to and covering a top of the sets of rib members (A). Each set of rib members (A) include a stretcher 2, an outer rib 3, a auxiliary rib 4, and a link 5, which are pivotally connected to one another in a predetermined manner. Wherein, the stretcher 2 is pivotally connected at an inner end 21 to the lower hub 13 and at an outer end 22 to a near-inner end 32 of the outer rib 3, the auxiliary rib 4 is pivotally connected at an inner end 41 to the upper hub 12 and at an outer end 42 to a near-middle point 23 of the stretcher 2, and the link 5 is pivotally connected at an inner end 51 to a near-outer end 43 of the auxiliary rib 4, and at an outer end 52 to an inner end 31 of the outer rib 3. And, a rib-pulling mechanism 6 is provided between each stretcher 2 and a corresponding outer rib 3 thereof to give the above-described skeleton a wind-protecting ability.

Figure 4:
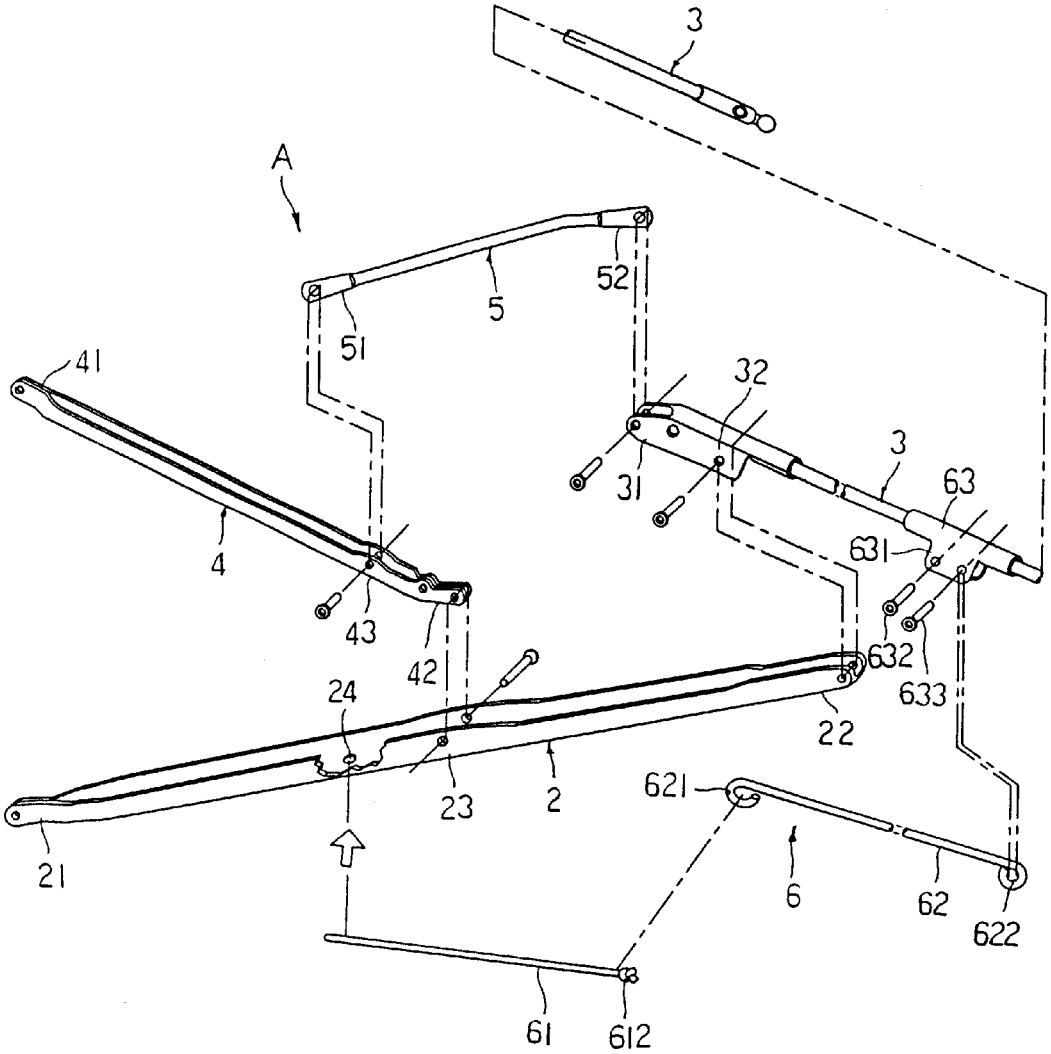
FIG. 4 is an exploded perspective view of a set of rib members for the wind-protecting skeleton according to a first embodiment of the present invention.

FIG. 4 is an exploded perspective view of one set of rib members (A) for the wind-protecting skeleton for folding umbrella according to a first embodiment of the present invention. In this first embodiment, the rib-pulling mechanism 6 includes a flexible pull cord 61 and a rigid wire 62 located at an axially outer side of the pull cord 61. The rigid wire 62 is formed at two ends with an inner eye 621 and an outer eye 622. The outer eye 622 is pivotally connected to a coupling device 63 that is fixedly connected to the outer rib 3 at a predetermined position. The coupling device 63 has two sides that downward extend to form two spaced ear portions 631. A first coupling pin 632 and a second coupling pin 633 parallelly extend across the two ear portions 631. The outer eye 622 of the rigid wire 62 is extended over the first coupling pin 632 to pivotally connect to the second coupling pin 633. The flexible pull cord 61 has two ends being separately tied into an inner knot 611 that is directly or indirectly held to the stretcher 2 at a predetermined position, and an outer knot 612 that is held to the inner eye 621 of the rigid wire 62.

Figure 5:
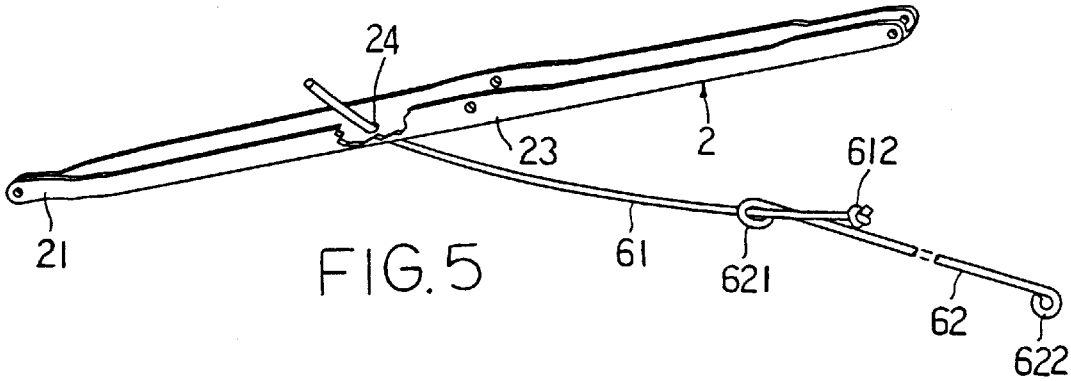
FIG. 5 shows an inner end of a pull cord included in the wind-protecting skeleton of FIG. 4 is extended through a hole on a stretcher of the skeleton.
Figure 6:
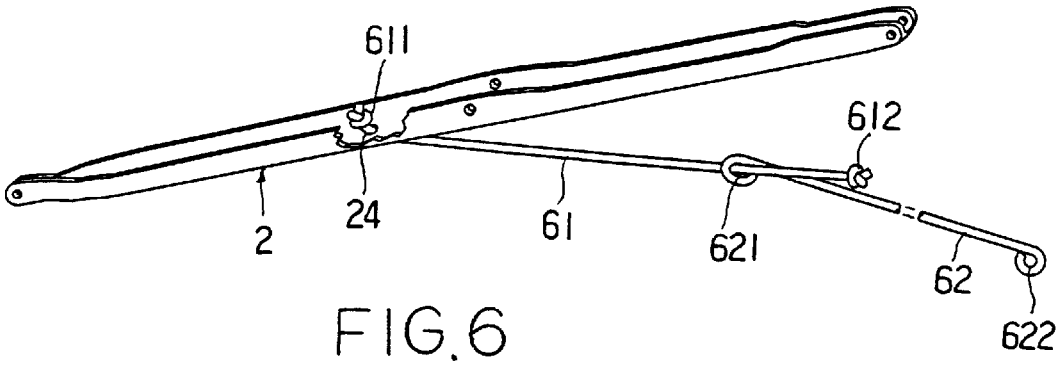
FIG. 6 shows the inner end of the pull cord of FIG. 5 has been knotted and held to an inner side of the stretcher.

FIGS. 5 and 6 show the manner of connecting the flexible pull cord 61 to the stretcher 2 in the first embodiment of the present invention. As shown in FIG. 5, the stretcher 2 is provided between the inner end 21 and the near-middle point 23 at a predetermined position with a through hole 24. An inner end of the pull cord 61 is upward threaded through the through hole 24 and then tied into the inner knot 611, so that the inner knot 611 is directly held to an inner side of the stretcher 2 at the through hole 24, as shown in FIG. 6.

Referring back to FIG. 3. The outer ribs 3 support an outmost peripheral part of the cover 14 that has a big area and is subject to a bigger wind force than other areas on the cover 14, making the outer ribs 3 an inherently structurally weak portion on the umbrella. However, this weak portion is compensated with the flexible pull cord 61 and the rigid wire 62 of the rib-pulling mechanism 6 provided between each set of stretcher 2 and outer rib 3. When the umbrella is fully stretched, the rib-pulling mechanisms 6 firmly inwardly pull the outer ribs 3 at the coupling device 63, making the outer ribs 3 a solidified structure. Even when a strong wind force (P) blows upwardly against an inner side of the cover 14, the outer ribs 3 are well protected by the rib-pulling mechanisms 6 from being turned upwardly and deformed or broken.

Figure 7:
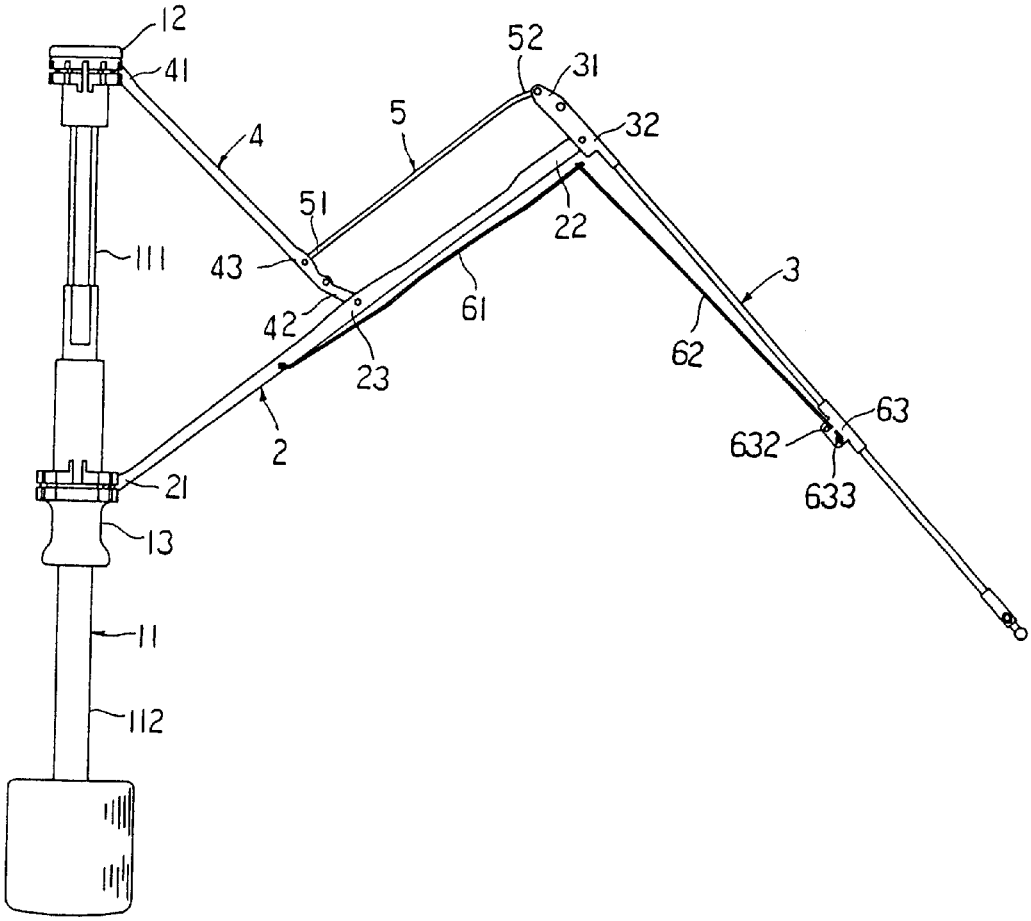
FIG. 7 shows the wind-protecting skeleton of FIG. 3 in a partially collapsed state.

FIG. 7 shows the wind-protecting skeleton having the rib-pulling mechanism 6 mounted to each set of rib members according to the first embodiment of the present invention is partially collapsed. It can be seen from FIG. 7, the rigid wires 62 and the flexible pull cords 61 match very well with the sets of rib members (A) and do not interfere with a smooth collapsing of the rib members (A). When the lower hub 13 is pulled downward along the shaft 11, the stretcher 2, the auxiliary rib 4, the link 5, and the outer rib 3 of each set of rib members (A) are sequentially moved toward the shaft 11. At this point, the flexible pull cord 61 and the rigid wire 62 are moved toward the stretcher 2 and the outer rib 3, respectively, and bent at the inner eye 621 of the rigid wire 62. More specifically, the rigid wire 62 is made of a rigid material with some extent of elasticity, and the outer eye 622 thereof is connected to the outer rib 3 via the coupling device 63. When the folding umbrella is collapsed, the rib-pulling mechanism 6 is released from any stretching force and the rigid wire 62 is in a load-free state to collapse along with the outer rib 3 due to an elastic restoration thereof.

As mentioned above, the outer eye 622 of the rigid wire 62 extends over the first coupling pin 632 to pivotally connect to the second coupling pin 633. The first coupling pin 632 acts to restrict a maximum tension of the rigid wire 62 when the umbrella is stretched, and to limit the inner eye 621 of the rigid wire 62 to move upward to a collapsed position when the umbrella is collapsed and the rigid wire 62 is not subject to any pull force. Although the flexible pull cord 61 is a soft member, it is pulled at the outer knot 612 by the upward moved inner eye 621 to move upward and keeps the flexible pull cord 61 in a straight state when the stretcher 2 is moved toward the shaft 11 at the time the umbrella is collapsed.

Figures 8, 9:
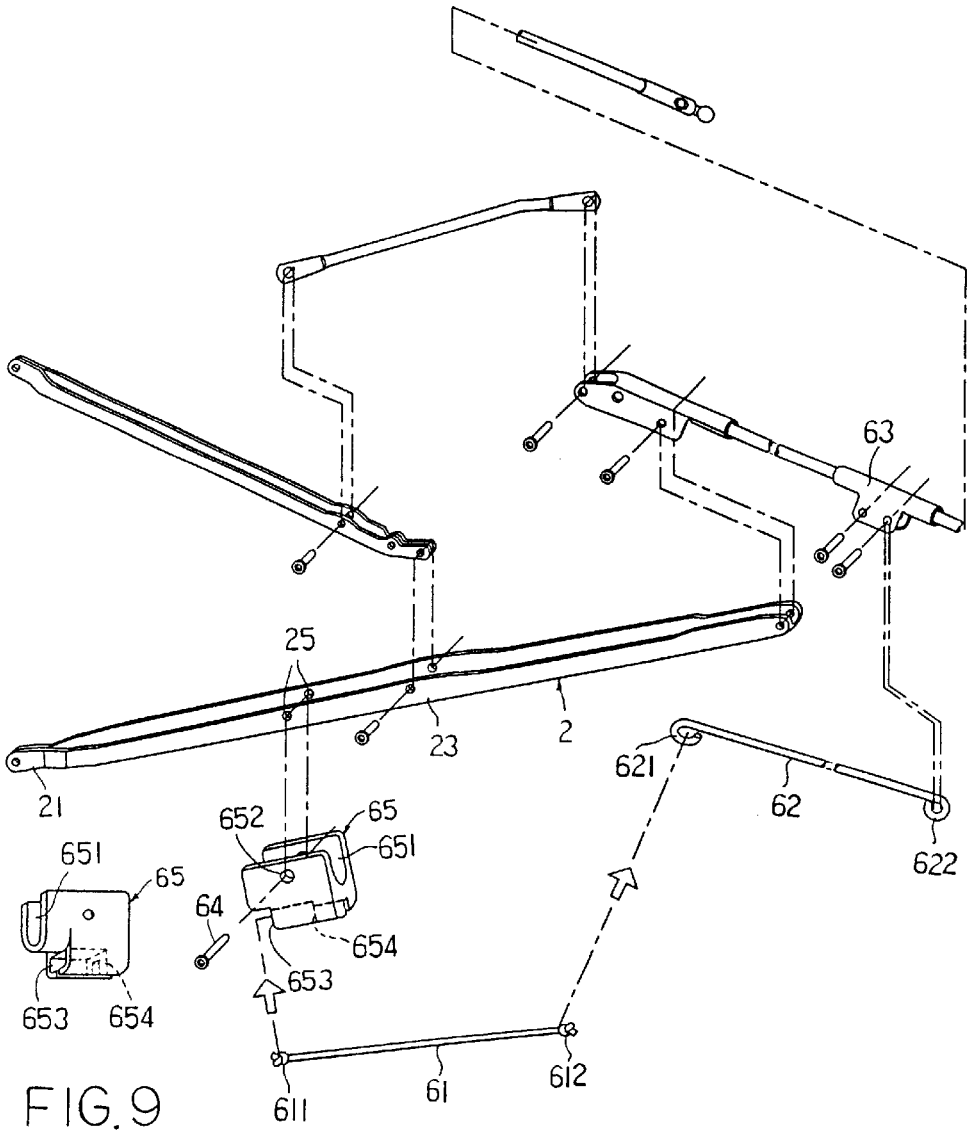
FIG. 8 is an exploded perspective view of a set of rib members for the wind-protecting skeleton according to a second embodiment of the present invention.
FIG. 9 is a perspective view of a cord holder included in the wind-protecting skeleton of FIG. 8, as viewed from an inner end thereof.

FIG. 8 is an exploded perspective of a set of rib members for the wind-protecting skeleton for folding umbrella according to a second embodiment of the present invention. This second embodiment is generally similar to the first embodiment except that the flexible pull cord 61 is connected to the stretcher in a different manner. A cord holder 65 is fixed to a predetermined position on the stretcher 2 between the inner end 21 and the near-middle point 23 by means of fixing pins 64. The cord holder 65 is provided at a top with an open-topped recess 651 corresponding to a cross sectional shape of the stretcher 2 for fitting onto a outer side of the stretcher 2. Fixing holes 652 are provided at two wall portions of the recess 651 corresponding to fixing holes 25 provided on the stretcher 2, so that fixing pins 64 could be extended through the fixing holes 652 and 25 to firmly mount the cord holder 65 to the stretcher 2. The cord holder 65 is provided at a bottom with a T-shaped long slot 653, in which a stop wall 654 is provided. An inner end of the pull cord 61 is pre-tied into an inner knot 611 that is received in an expanded upper portion of the T-shaped long slot 653 and held to an axially inner side of the slot 653 by the stop wall 654. FIG. 9 is a perspective view of the cord holder 65 viewed from an axially inner end thereof. Thus, the pull cord 61 is indirectly connected to the stretcher 2 via the cord holder 65.

Figures 10, 11:
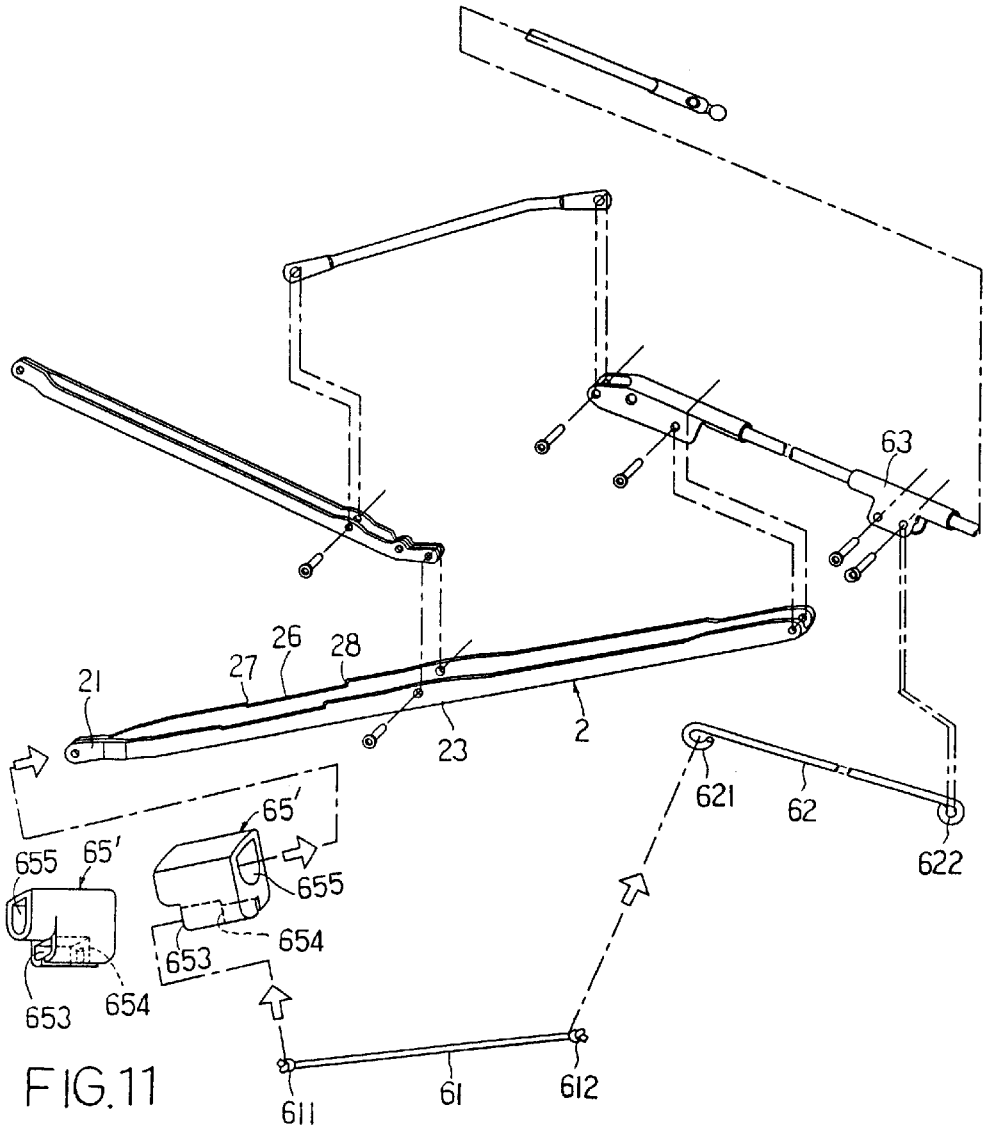
FIG. 10 is an exploded perspective view of a set of rib members for the wind-protecting skeleton according to a third embodiment of the present invention.
FIG. 11 is a perspective view of a cord holder included in the wind-protecting skeleton of FIG. 10, as viewed from an inner end thereof.

FIG. 10 is an exploded perspective of a set of rib members for the wind-protecting skeleton for folding umbrella according to a third embodiment of the present invention. This third embodiment is generally similar to the second embodiment except that the flexible pull cord 61 is connected to the stretcher in a different manner. A portion of the stretcher 2 between the inner end 21 and the near-middle point 23 is cut away to provide a recess portion 26. An axially inner end of the recess portion 26 forms a low stop wall portion 27 and an axially outer end of the recess portion 26 forms a high stop wall portion 28. A cord holder 65' is provided at a top with a sleeve portion 655 through which the stretcher 2 could be extended. The sleeve portion 655 is so sized that the cord holder 65' could pass the low stop wall portion 27 but not the high stop wall portion 28. That is, the cord holder 65' is limited to the recess portion 26 between the low and high stop wall portions 27, 28. The cord holder 65' is provided at a bottom with a T-shaped long slot 653, in which a stop wall 654 is provided. Again, an inner end of the pull cord 61 is pre-tied into an inner knot 611 that is received in an expanded upper portion of the T-shaped long slot 653 and held to an axially inner side of the slot 653 by the stop wall 654. FIG. 11 is a perspective view of the cord holder 65' viewed from an axially inner end thereof. Thus, the pull cord 61 is indirectly connected to the stretcher 2 via the cord holder 65'.

Figure 12:
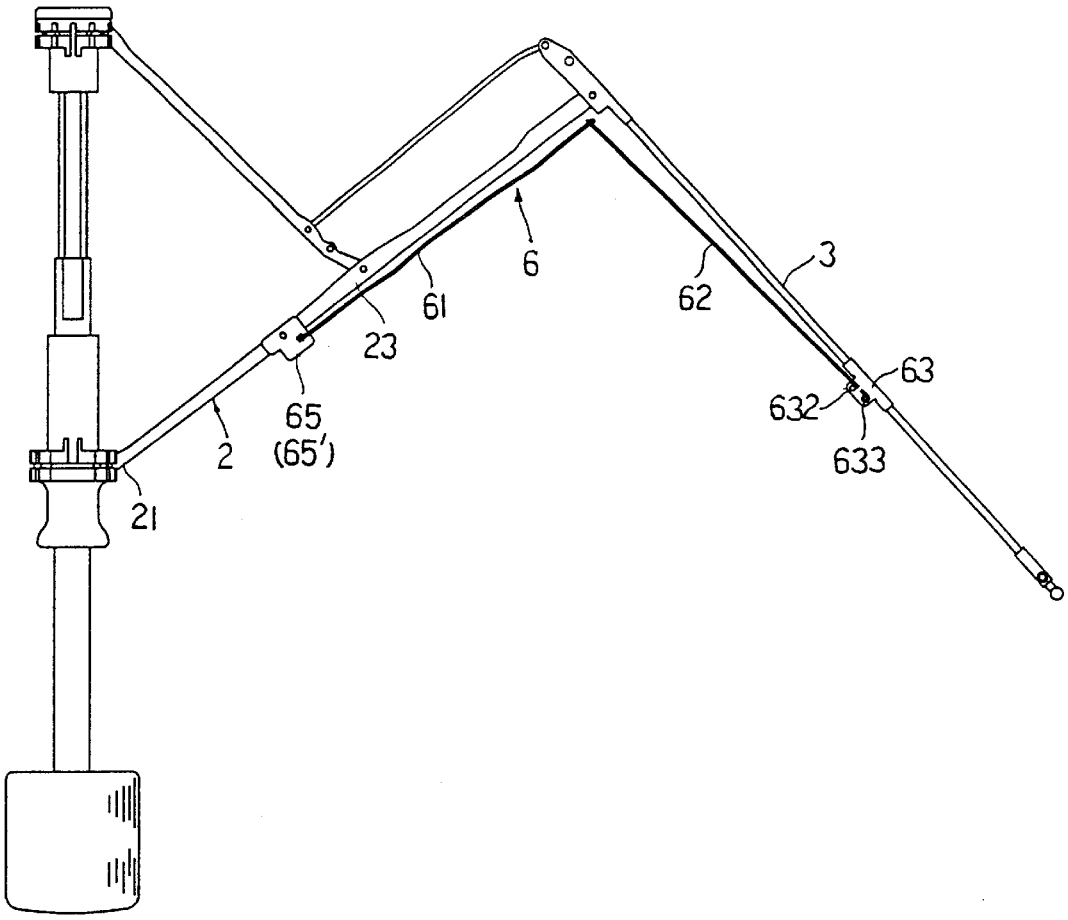
FIG. 12 shows the wind-protecting skeleton of FIGS. 8 and 10 in a partially collapsed state.

FIG. 12 shows the wind-protecting skeleton shown in FIGS. 8 and 10 is partially collapsed. It can be seen from FIG. 12 the cord-pulling mechanism 6 in the second and the third embodiment of the present invention also provides the same effect as that of the first embodiment. That is, when the umbrella is stretched, the rigid wire 62 and the flexible pull cord 61 together pull the outer rib 3 inward to protect the outer ribs from turning upward or breaking due a strong wind blowing against an inner side of the umbrella; and when the umbrella is collapsed, the rigid wire 62 and the flexible pull cord 61 well match with the rib members (A) to move to a collapsed position.

What is claimed is:

1. A wind-protecting skeleton for a folding umbrella, comprising:

a telescopic shaft formed from at least a lower section and an upper section telescopically received in said lower section;

an upper hub fixedly mounted to a top of said shaft;

a lower hub upwardly and downwardly movably mounted on said shaft; and a plurality of sets of rib members pivotally connected to said lower and said upper hubs for holding a cover thereto;

each said set of fib members comprising;

an outer rib;

a stretcher having an inner end pivotally end connected to said lower hub and an outer end pivotally connected to a near-inner end of said outer rib;

an auxiliary rib having an inner end pivotally connected to said upper hub and an outer end pivotally connected to a near-middle point of said stretcher;

a link having an inner end pivotally connected to a near-outer end of said auxiliary rib and an outer end pivotally connected to an inner end of said outer rib;

a coupling device fixedly connected to said outer rib at a predetermined position and having two ear portions which extend downwardly from two sides of said coupling device;

a first coupling pin and a second coupling pin extended across said two ear portions and spaced away from each other;

a rigid wire having an inner end that forms an inner eye and an outer end that forms an outer eye; said outer eye passing over said first coupling pin to pivotally connect to said first coupling pin; and a flexible pull cord having an inner end and an outer end each tied into an inner knot and an outer knot, respectively; said outer knot being held to said inner eye of said rigid wire and said inner knot being held to a predetermined position between said inner end and said near-middle point of said stretcher.

2. The wind-protecting skeleton for a folding umbrella as claimed in claim 1, wherein said stretcher is provided at said predetermined position between said inner end and said near-middle point of said stretcher with a through hole, via which said inner end of said flexible pull cord is extended and then tied into said inner knot, so that said inner knot is held to an inner side of said stretcher at said through hole for said pull cord to directly connect to said stretcher.

3. The wind-protecting skeleton for a folding umbrella as claimed in claim 1, wherein said stretcher is provided at said predetermined position between said inner end and said near-middle point of said stretcher with a cord holder that is fixedly connected to said stretcher with fixing pins; said cord holder including an open-topped recess corresponding to a cross sectional shape of said stretcher for engaging with an outer side of said stretcher, two fixing holes provided at two wall portions of said recess corresponding to fixing holes provided on said stretcher for said fixing pins to extend therethrough and firmly mount said cord holder to said stretcher, and a bottom T-shaped longitudinal slot with a stop wall provided therein; and said inner knot of said flexible pull cord being received in said T-shaped longitudinal slot and held to an axially inner side of said stop wall to indirectly connect said pull cord to said stretcher.

4. The wind-protecting skeleton for a folding umbrella as claimed in claim 1, wherein said stretcher is provided at said predetermined position between said inner end and said near-middle point of said stretcher with a recess portion, and a cord holder mounted in said recess portion; a low stop wall portion being formed between said stretcher and an axially inner end of said recess portion, and a high stop wall portion between said stretcher and an axially outer end of said recess portion; said cord holder including a top sleeve portion through which said stretcher is extended, said top sleeve portion being so sized that said low stop wall portion can pass therethrough while inhibiting said high stop portion from passing therethrough thereby limiting said cord holder to said recess portion between said low and said high stop wall portions, and the cord holder further comprising a bottom T-shaped longitudinal slot having a stop wall provided therein; and said inner knot of said flexible pull cord being received in said T-shaped long slot and held to an axially inner side of said stop wall to indirectly connect said pull cord to said stretcher.

* * * * *